US005873461A

United States Patent [19]

Turbett et al.

[11] Patent Number: 5,873,461

[45] Date of Patent: Feb. 23, 1999

[54] RECLOSABLE DISPENSER

[75] Inventors: James Turbett, Darien, Conn.; Mark Thorn, River Vale, N.J.; Raymond Flaig, Stamford, Conn.

[73] Assignee: Chesebrough-Pond's USA Co., Division of Conopco, Inc., Greenwich, Conn.

[21] Appl. No.: 876,158

[22] Filed: Jun. 13, 1997

[51] Int. Cl.[6] ..... B65D 83/10

[52] U.S. Cl. ..... 206/362; 220/4.23; 220/326

[58] Field of Search ..... 206/362, 362.4; 220/4.23, 326, 339

[56] References Cited

U.S. PATENT DOCUMENTS 4,787,552 11/1988 Natori ..... 220/4.23
4,919,259 4/1990 Beaulieu ..... 206/45.2
4,989,730 2/1991 Lemoine ..... 206/362
5,526,953 6/1996 Chieng ..... 220/4.23
5,549,200 8/1996 Cowan et al. .
5,586,653 12/1996 Taveroff ..... 206/362

*Primary Examiner*—Paul T. Sewell
*Assistant Examiner*—Nhan T. Lam
*Attorney, Agent, or Firm*—Milton L. Honig

[57] ABSTRACT

A reclosable dispenser is provided which includes a receptacle, preferably a unitarily molded plastic thermoform, for holding dry goods such as cotton swabs and a reclosable lid hingedly attached to the receptacle. The lid has a cover substantially co-extensive with the open top of the receptacle and includes a cover with a flap extension at an end thereof oriented perpendicular to the cover. A slot in the flap extension lockingly receives a rigid tab formed along a flange atop a front wall of the receptacle. The tab and slot arrangement allows for easy opening but secure closure of the dispenser.

8 Claims, 2 Drawing Sheets

RECLOSABLE DISPENSER

BACKGROUND OF THE INVENTION

1. Field of the Invention

The invention concerns a reclosable dispenser, especially for dispensing cotton swabs.

2. The Related Art

Cotton swabs and other types of multi-unit dry goods have been sold in a great variety of packages. Particularly common packaging for cotton swabs is a clear thermoformed blister pack with paperboard backing that closes an open face of the blister. Perforations in the paperboard allow upon tearing a consumer's entry into the package for removal of product. The flap formed by the tear along the perforation is difficult, if not impossible, to reseal.

U.S. Pat. No. 5,549,200 (Cowan et al.) provides one solution to this problem. A blister pack with totally peelable top face is placed within a clear, hard plastic outer case with movable lid. When empty, the blister pack is replaced with a refill. The outer box is retained for reuse. Although a significant advance, the outer box is expensive and heavy. This system is best utilized in institutions rather than in the low volume usage of individual consumers. Better dispensing systems are necessary.

Accordingly, it is an object of the present invention to provide a reclosable dispenser for use with many types of dry goods, but especially cotton swabs, which is relatively inexpensive to manufacture.

Another object of the present invention is to provide a reclosable dispenser for dry goods, especially cotton swabs, which in its open position allows access to more than a single unit or swab.

These and other objects of the present invention will become more apparent through consideration of the following summary and detailed discussion.

SUMMARY OF THE INVENTION

A reclosable dispenser is provided which includes:

(i) a receptacle for holding product to be dispensed, the receptacle formed of front and rear walls opposite one another, left and right sidewalls opposite one another and a bottom wall, and a front, rear, left and right flange formed along respective upper edges of the respective front, rear, left and right walls, the flanges being parallel to the bottom wall and defining an open top of the receptacle, and a tab formed along the front flange projecting outwardly therefrom; and (ii) a lid having a cover substantially co-extensive with the open top and with the front, rear, left and right flanges, the cover being hingedly attached to the rear flange, the lid including a flap extension attached to a front edge of the cover, oriented perpendicular to the cover and having an engagement slot for lockingly receiving the tab.

The receptacle is preferably unitarily molded as a plastic thermoform. The thermoform is preferably a transparent blister while the lid is paperboard. Advantageously the paperboard lid will be spot welded to both left and right flanges of the thermoform in an area adjacent the front flange. Other areas along the flanges will not be adhesively attached to the lid. Spot welding is desirable because in the initial opening only minimal tear damage will occur to the paperboard and separation will be clean. Damaged paperboard must be avoided to allow retention of maximum strength in the lid.

The cover is hingedly connected by a plurality of perforations parallel to and adjacent the rear flange. Along a portion of the cover may be formed a window for viewing or even dispensing single units. The flap extension of the lid can have a dorsal and ventral panel forming a V-shaped latch with broadened end adjacent the front flange when the cover is in a closed position. The engagement slot for receiving the tab is formed in the ventral panel along the broadened end. The ventral panel is connected to a support panel adjacent the broadened end. The support panel is attached to an undersurface of the cover. The flap extension remains perpendicular to the cover because the former is made by the folding and gluing of the support panel to the underside of the cover. This creates an area for the tab to engage into and also results in the slot not being visible from outside of the package. Lifting the flap extension outwardly pulls the slot away from the tab allowing the cover to hinge open.

Along the front wall there may be placed a beveled segment for rigidly supporting the tab. The relative stiffness of the tab, even over other areas of the flange, combined with the highly flexible nature of the flap extension allows for secure closure but relatively easy opening.

BRIEF DESCRIPTION OF THE DRAWINGS

The above features, advantages and objectives of the present invention will be more fully appreciated through the following detailed discussion, reference being made to the drawing in which.

DETAILED DESCRIPTION OF THE INVENTION

Figure 1:
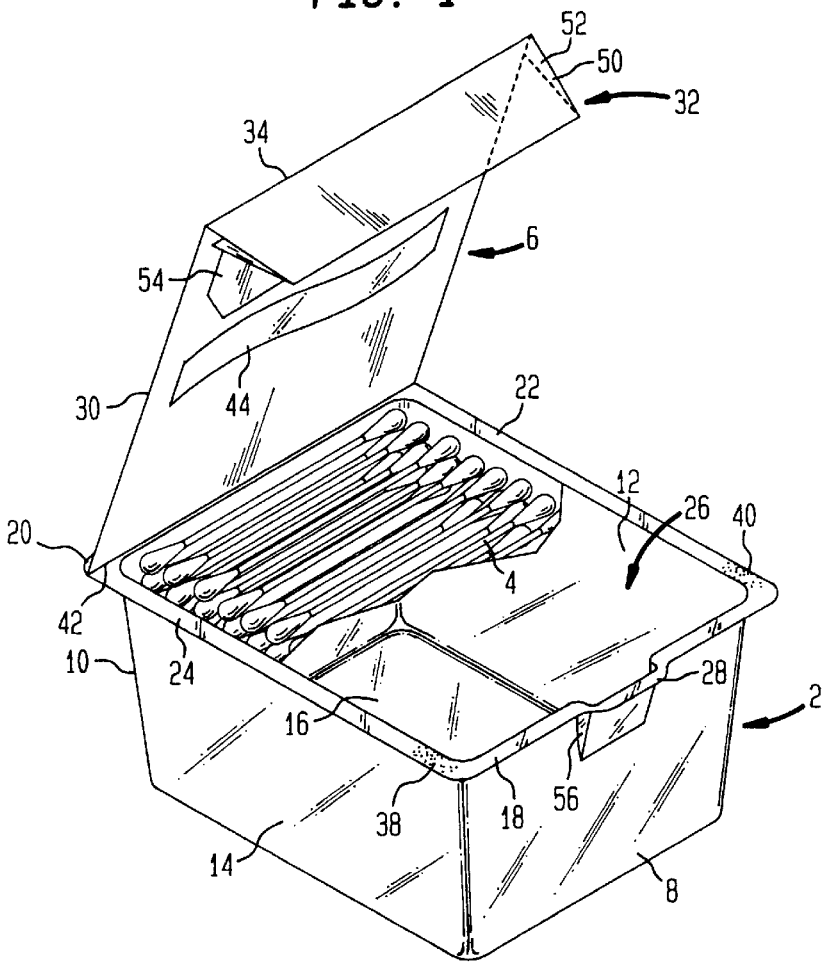
FIG. 1 is a plan perspective view of the dispenser with lid in the open position and for illustrative purposes only showing four cotton swabs contained therein.

FIG. 1 illustrates the reclosable dispenser which includes a receptacle 2 for holding products, such as cotton swabs 4, and a lid 6. The receptacle is formed from front and rear walls 8, 10 opposite one another, left and right side walls 12, 14 opposite one another and a bottom wall 16. Front 18, rear 20, left 22 and right 24 flanges are formed on respective upper edges of the respective front, rear, left and right walls. The flanges are parallel to the bottom wall and define an open top 26 of the receptacle. Projecting outwardly from the front flange is a tab 28.

Paperboard lid 6 has a cover 30 substantially co-extensive with the open top and with the front, rear, left and right flanges. Included with the lid is a flap extension 32 attached to a front edge 34 of the cover. The flap extension is oriented perpendicular to the cover and has an engagement slot 36 for lockingly receiving the tab. Receptacle 2 is unitarily molded as a plastic transparent thermoform. Lid 6 is spot welded in areas 38 and 40 to the left and right flanges adjacent the front flange.

A series of perforations 42 weaken the cover sufficiently to allow the perforations to function as a hinge. These perforations are parallel to and adjacent the rear flange. A dispensing window 44 is located in the cover between the perforated hinge and a flap extension.

Flap extension 32 includes a dorsal 46 and ventral 48 panel formed into a V-shaped latch 50 with broadened end 52 adjacent the front flange when the cover is in a closed position. A slot 36 is cut into the ventral panel along the broadened end. Further, the ventral panel is connected to a support panel 54 adjacent the broadened end. Support panel 54 is adhesively attached to an under surface of the cover thereby rendering the V-shaped latch sufficiently strong to engage the tab.

Along the front panel of the receptacle is thermoformed a beveled segment 56. This segment is intended to rigidly support the tab.

Figure 2:
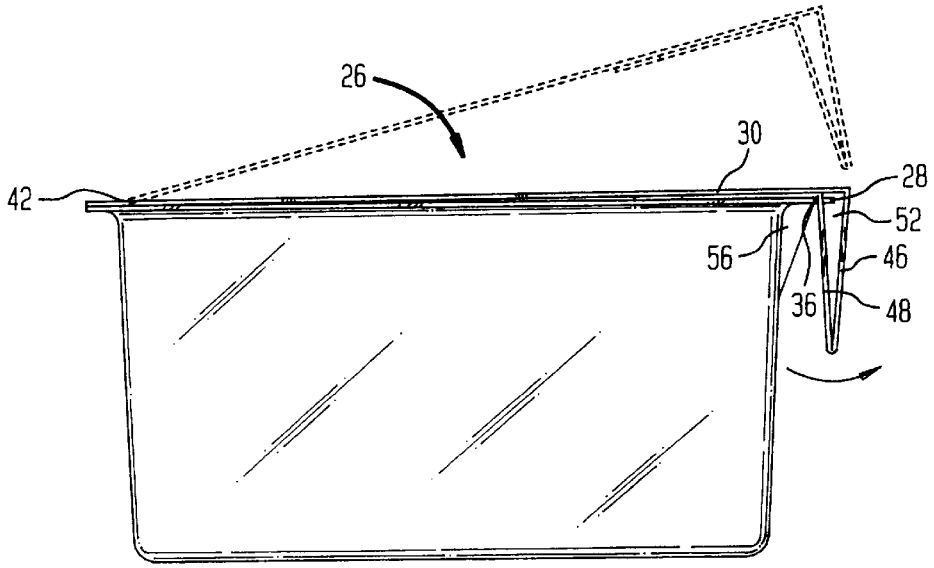
FIG. 2 is a side elevational view illustrating the open and closed lid position of the dispenser, the lid in the closed position being presented in partial cross section to better illustrate the tab/slot closing mechanism.

When opening the dispenser, one or more fingers are placed between the receptacle and flap extension. By outward movement in direction O as illustrated in FIG. 2, the lid separates from the tab. Phantom lines in FIG. 1 illustrate in side view the open lid position.

Figure 3:
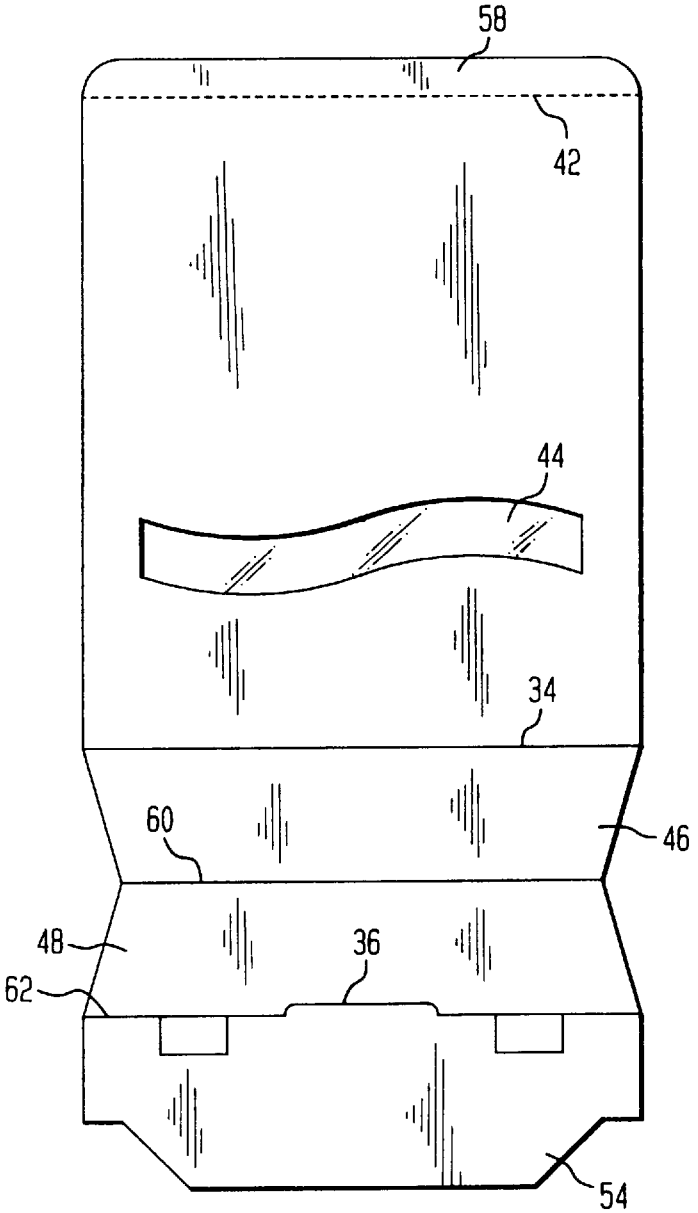
FIG. 3 is a plan view of the lid in die cut form prior to bending and adhesive attachment to the thermoformed receptacle.

FIG. 3 provides a better view of the paperboard lid, illustrated as a die cut blank. Pivot segment 58 is adhesively attached on its underside to rear flange 20 of the receptacle thermoform. Assembled, the die cut will be folded inwardly along front edge 34. The V-shaped flap extension is created by folding the dorsal and ventral panels 46, 48 inwardly along flap edge 60. Support edge 62 is then folded outwardly such that support panel 54 lies beneath cover 30 to which it is then adhesively attached. Support panel 54 should therefore be substantially perpendicular to ventral panel 48 thereby allowing formation of slot 36.

The foregoing description and drawing illustrate selected embodiments of the present invention and in light thereof various modifications will be suggested to one skilled in the art, all of which are within the spirit and purview of this invention.

What is claimed is:

1. A reclosable dispenser comprising:

(i) a receptacle for holding product to be dispensed, the receptacle formed of front and rear walls opposite one another, left and right sidewalls opposite one another and a bottom wall, and a front, rear, left and right flange formed along respective upper edges of the respective front, rear, left and right walls, the flanges being parallel to the bottom wall and defining an open top of the receptacle, and a tab formed along the front flange projecting outwardly therefrom, a thermoformed beveled segment is formed along the front panel of the receptacle and below the front flange to rigidly support the tab; and (ii) a lid having a cover co-extensive with the open top and with the front, rear, left and right flanges, the cover being hingedly attached to the rear flange, the lid including a flap extension attached to a front edge of the cover, oriented perpendicular to the cover and having an engagement slot for lockingly receiving the tab, the flap extension also having a dorsal and ventral panel forming a V-shaped latch with broadened end adjacent the front flange when the cover is in a closed position, the receptacle is unitarily molded as a plastic thermoform and the lid is made out of paperboard material.

2. The dispenser according to claim 1 wherein the thermoform is transparent.

3. The dispenser according to claim 1 wherein the lid is spot welded to both the left flange and the right flange.

4. The dispenser according to claim 3 wherein the spot welds on the left and right flanges are adjacent the front flange.

5. The dispenser according to claim 1 wherein the cover is hingedly connected through a plurality of perforations parallel to and adjacent the rear flange.

6. The dispenser according to claim 1 wherein the cover includes a dispensing window.

7. The dispenser according to claim 1 wherein the slot is formed in the ventral panel along the broadened end.

8. The dispenser according to claim 7 wherein the ventral panel includes a support panel adjacent the broadened end, the support panel being attached to an undersurface of the cover.

* * * * *